United States Patent [19]

Wiggers

[11] Patent Number: 5,054,708

[45] Date of Patent: Oct. 8, 1991

[54] DEVICE FOR SLIPPING WINDING CORES ONTO EXPANDING SHAFTS WITH A GIVEN RELATIVE POSITIONING

[75] Inventor: Winfried Wiggers, Rheine, Fed. Rep. of Germany

[73] Assignee: Windmoeller & Hoelscher, Lengerich, Fed. Rep. of Germany

[21] Appl. No.: 473,662

[22] Filed: Feb. 2, 1990

[30] Foreign Application Priority Data

Feb. 3, 1989 [DE] Fed. Rep. of Germany ..... 3903270

[51] Int. Cl.[5] ..... B65H 19/30

[52] U.S. Cl. ..... 242/67.10 R; 242/56 R

[58] Field of Search ..... 242/67.1 R, 67.2, 67.3 R, 242/56 R, 56 A; 414/745.1, 745.7, 746.1, 746.2, 746.4, 746.7, 745.9

[56] References Cited

U.S. PATENT DOCUMENTS

| | | | |
|---|---|---|---|
| 3,045,846 | 7/1962 | Clark | 414/745.1 X |
| 3,776,482 | 12/1973 | Mras | 242/67.1 R |
| 4,929,138 | 5/1990 | Breuning | 414/745.7 X |

FOREIGN PATENT DOCUMENTS

| | | | |
|---|---|---|---|
| 647541 | 4/1935 | Fed. Rep. of Germany | 242/67.2 |
| 1112392 | 12/1959 | Fed. Rep. of Germany | 242/67.1 R |
| 2237817 | 2/1975 | France | 414/746.1 |
| 873341 | 7/1961 | United Kingdom | 414/746.4 |

*Primary Examiner*—Daniel P. Stodola
*Assistant Examiner*—John P. Darling
*Attorney, Agent, or Firm*—Fleit, Jacobson, Cohn, Price, Holman & Stern

[57] ABSTRACT

An arrangement wherein a frame with mutually parallel guide tracks for transversely placed winding cores fed thereto is mounted in a stand, the distance of the guide tracks from each other or the distance of the winding cores mounted in it is the same as their desired distance on the winding shafts. The front parts of the tracks are provided with recesses in such a manner that the winding cores are exposed on parts thereof which are mutually opposite to each other, and respective tong-like grippers are provided in the stand for each of the winding cores so that their gripping jaws substantially simultaneously engage opposite sides of the winding cores, and the grippers and the frame are adapted to be so relatively moved that the winding shaft may be inserted through the aligned bores of the winding cores lifted from the tracks and held by the grippers in order to take up the cores.

13 Claims, 6 Drawing Sheets

DEVICE FOR SLIPPING WINDING CORES ONTO EXPANDING SHAFTS WITH A GIVEN RELATIVE POSITIONING

FIELD OF THE INVENTION

The invention relates to a device for slipping a plurality of winding cores onto expanding winding shafts with a given relative positioning of the same.

BACKGROUND OF THE INVENTION

For winding up flat webs more specifically in the form of narrow film webs, it is conventional to use winding shafts which carry spaced winding cores which they hold by expanding in diameter. The flat webs arranged side by side are then wound on the cores to form rolls. In order to mount the winding cores on the winding shafts the individual winding cores are slipped by hand onto them, then aligned on the shafts and tightly engaged by expanding the shafts. This manner of mounting the winding cores on the winding shafts is not only a slow process but also calls for a substantial amount of concentration on the part of the workforce to align the winding cores in relation to each other properly.

SUMMARY OF THE INVENTION

One object of the invention is thus to provide a device of the initially mentioned type which makes it possible to slip a number of winding cores onto an expanding winding shaft reliably and with the desired relative positioning.

In the context of a device of the type initially mentioned this aim is achieved in the invention by an arrangement wherein a frame with mutually parallel guide tracks for transversely placed winding cores fed thereto is mounted in a stand, the distance of the guide tracks from each other or the distance of the winding cores mounted in it is the same as their desired distance on the winding shafts. The front parts of the tracks are provided with recesses in such a manner that the winding cores are exposed on parts thereof which are mutually opposite to each other, and respective tong-like grippers are provided in the stand for each of the winding cores so that their gripping jaws substantially simultaneously engage opposite sides of the winding cores, and the grippers and the frame are adapted to be so relatively moved that the winding shaft may be inserted through the aligned bores of the winding cores lifted from the tracks and held by the grippers in order to take up the cores.

Without having to resort to tedious manual operations and without any errors due to inadvertence on the part of the machine attendant the device in accordance with the invention makes it possible to load the winding shafts with the winding cores with the correct relative positioning of the winding cores on the winding shaft. It is only necessary to place the winding cores in the guide tracks, whose number is equal to the maximum number of winding cores to be received on a winding shaft. The winding cores roll forward, preferably due to an oblique setting of the rear part of the guide tracks, until the winding cores which are moved respectively to the fore, strike abutments delimiting the guide tracks. Since the winding cores located in front of the abutments are exposed on opposite sides, they are able to be engaged by the gripping jaws of the grippers. In this respect the grippers are so designed in accordance with the invention that their gripping jaws essentially simultaneously engage the opposite sides of the winding cores so that when they are engaged by the grippers it is not possible for the winding cores to be displaced any further.

Then the row of grippers is lifted or the frame is lowered so that the grippers hold the winding cores with the correct relative distance between them and the winding shaft may be inserted through the aligned bores of the winding cores. After the winding shaft has been inserted into the bores of the winding cores in the correct relative position, the winding shaft is expanded so that the winding cores are engaged and held by the shaft with the correct relative positioning. The winding shaft with the winding cores mounted thereon may then be placed on a winding machine or held in a state ready for placing on such a machine.

It is possible to provide special means in order to hold the winding shaft to be inserted through the bores of the winding cores held by the grippers. Furthermore it is possible for the device to insert the winding shaft into and through the bores, or the grippers to be such that they are able to be slid in the direction of the winding cores held by the same in such a manner that the grippers slide the winding cores onto the winding shaft held so that the winding shaft is stationary.

In order to provide a simple way of adjusting the device to different diameters of winding cores, in accordance with a further development of the invention the frame is slidingly carried in the stand at an angle which is about 45 degrees in relation to the track section supporting the front winding cores. This design ensures that in the case of a change in the setting of the frame, the center lines of the winding cores keep their positions in relation to the gripping jaws so that the synchronously opening and closing gripping jaws will be able to simultaneously engage the opposite sides of the winding cores even if the same have different diameters. The frame, which is able to slide transversely for adjustment to suit different diameters of the winding cores, and the stand may be provided with a pointer and graduations so that the device may be readily set to suit the respective diameters of winding cores.

The invention further contemplates guide tracks which are only formed by the end parts of guide rails supporting the winding cores and mounted in a sliding manner on transversely extending guides of the frame so that they may be locked in place thereon. This design provides a simple way of adjusting the device to different lengths of winding cores.

It is preferred for the guide rails to consist of angle section and/or T section.

The frame carrying the guide tracks may consist of a front part with generally horizontally arranged guide rails and a rear part with obliquely extending guide rails. When the winding cores are placed on the oblique part of the guide tracks, they will move the cores in front of them forwards until the same abut against the front abutments of the guide rails.

In accordance with an advantageous development of the invention the front part of the frame is pivoted on the rear part for swinging about a transverse axis and is able to be raised and lowered in relation to the same by a drive. This design makes it possible for the front part of the guide tracks to be pivoted away when an aligned row of winding cores has been engaged by the grippers so that the winding cores may be slipped on to the winding shaft without any impediment.

The rear part of the frame may be guided in oblique guides fixed to the stand and may be provided with an adjusting drive.

If the front sections of the guide rails, on which the winding cores are supplied to the grippers horizontally, the oblique guides for the frame in the stand will be placed at an angle of 45 degrees, this then ensuring that the center lines of the winding cores of different diameters are always in the same setting.

The adjusting drive for the frame may be made up of a lead screw and an endless chain driven thereby and running over bend sprockets and furthermore coupled with the frame.

It is furthermore convenient if each of the gripping jaws consists of gripping plates set at an angle to each other. Between such gripping plates it is possible for the winding cores to be held in a centered manner.

As a further convenient feature of the invention, the gripping jaws are attached to synchronously and oppositely moving pivoting arms. Such a synchronous pivoting motion may be caused by coupling the pivoting arms by toothed segments in mesh with each other and placed so as to be concentric to the pivot axes.

In accordance with a particularly preferred feature of the invention the gripping surfaces of the gripping jaws are provided on levers which are pivotally mounted on the pivoting arms so that their ends opposite to the gripping jaws are pivoted on the first ends of links, whose other, second ends are pivoted on girders which are at least indirectly fixed to the stand, the lengths of the levers and links being so selected that the levers bearing the gripping surfaces are aligned with each other substantially during the opening and closing motion. This design ensures that there will be a simultaneous engagement of the winding cores on opposite sides thereof even if the device is set for different size diameters of the winding cores. In accordance with a further advantageous feature of the invention there is the provision that the grippers are mounted on a common girder, which is able to be moved by a drive on a girder fixed to the stand so as to run parallel to the winding cores engaged by the grippers. This feature of the invention enables the winding cores to be slipped onto a winding shaft held in a stationary state.

BRIEF DESCRIPTION OF THE DRAWINGS

One embodiment of the invention will now be described with reference to the drawings.

DETAILED DESCRIPTION OF THE PREFERRED EMBODIMENT

Two supports of the stand, placed with a distance between them, are connected in their upper parts by a transverse girder 2.

Figure 2:
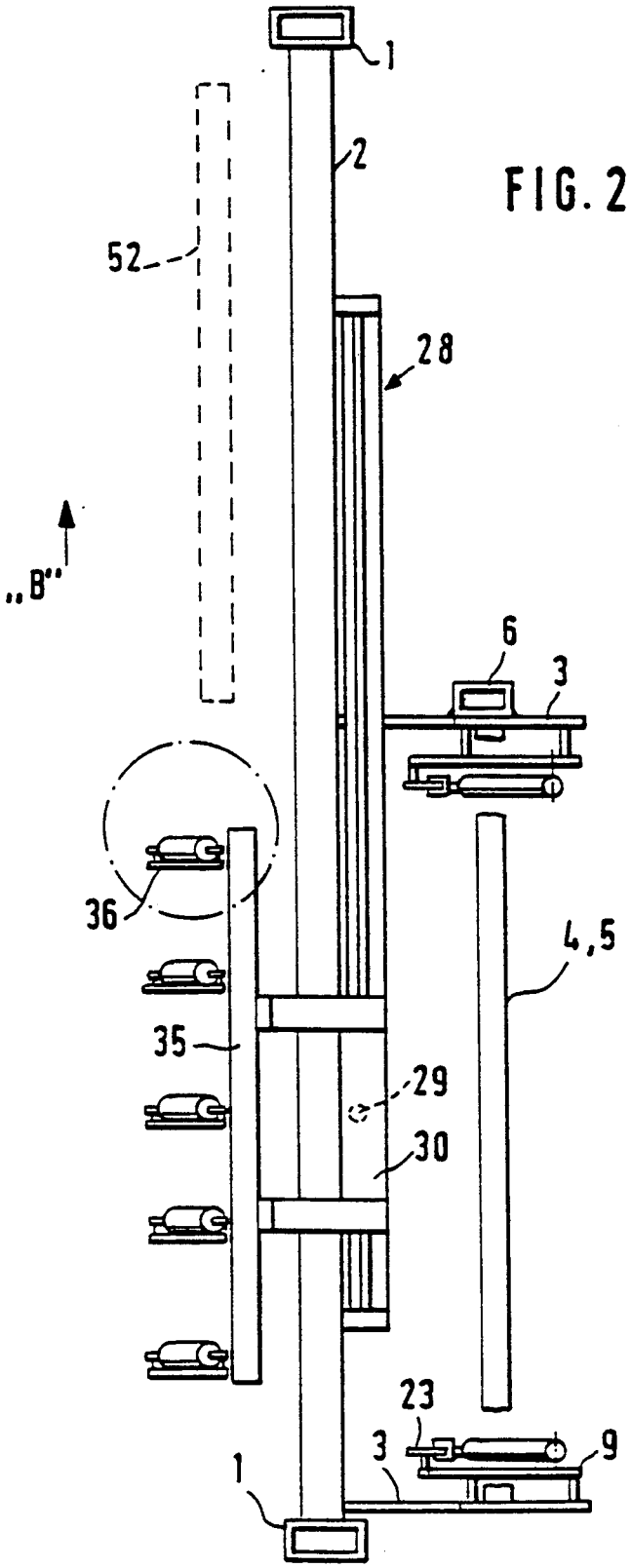
FIG. 2 is a plan view of the device of FIG. 1.

Two spaced plates 3 are welded to the transverse girder 2 and are connected together by two crosspieces 4 and 5. In order to prevent a sagging of the transverse girder 2, the plate 3, which is centrally welded to the transverse girder 2 (as shown in FIG. 2), is supported by square tubing 6. Each plate 3 has two slots 7 extending at an angle of 45 degrees to the horizontal which receive bolts 8. These bolts 8 are fixedly welded to a plate 9 so that the plate 9 is able to be moved in relation to the plate 3 by way of the bolts in the slots 7. For this purpose sprockets 10 are mounted on the plate 3 so as to be able to rotate freely and they have an endless sprocket chain 11 trained around them. This chain 11 is connected with a nut 12, which is placed on a lead screw 13. The latter is supported by two brackets 14 fixedly mounted on the plate 3, there being a handwheel 15 mounted on the extension of the lead screw 13. It is by turning this handwheel 15 that it is then thus possible to move the plate 9 (which carries a pin 9*a* connected with the plate and which is connected with the chain 11) in relation to the plate 3 in the direction of the arrow A (see FIG. 3) backwards and forwards. The two plates 9 are connected with each other by way of a piece of section 16 which on its upper face carries a plurality of guide rails 17. These guide rails are able to be adjusted in relation to each other. For this purpose the piece of section 16 has a plurality of slots 18, through which there downwardly extend bolts 19 which for their part are fixedly joined to the guide rails 17. On each bolt 19 a respective thumbscrew 20 is mounted so that after slackening off such thumbscrews 20, the guide rails 17 may be adjusted in relation to each other by moving along the length of slot 18. This adjustment is necessary in order to adapt the distance between the guide rails 17 to the length of the cores 21.

Furthermore each plate 9 is connected with a trunnion 22, on which a further plate 23 is respectively pivoted for free swinging motion on each plate 9. The swinging motion is in this case caused by a hydraulic piston and cylinder unit 24. Just like the plates 9, the plates 23 as well are connected together by a piece of section 25. This piece of section 25 is identical in structure to the piece of section 16 so that the guide rails 26 mounted on this piece of section 25 may also be set in relation to each other in accordance with the length of the winding cores 21.

Figure 3:
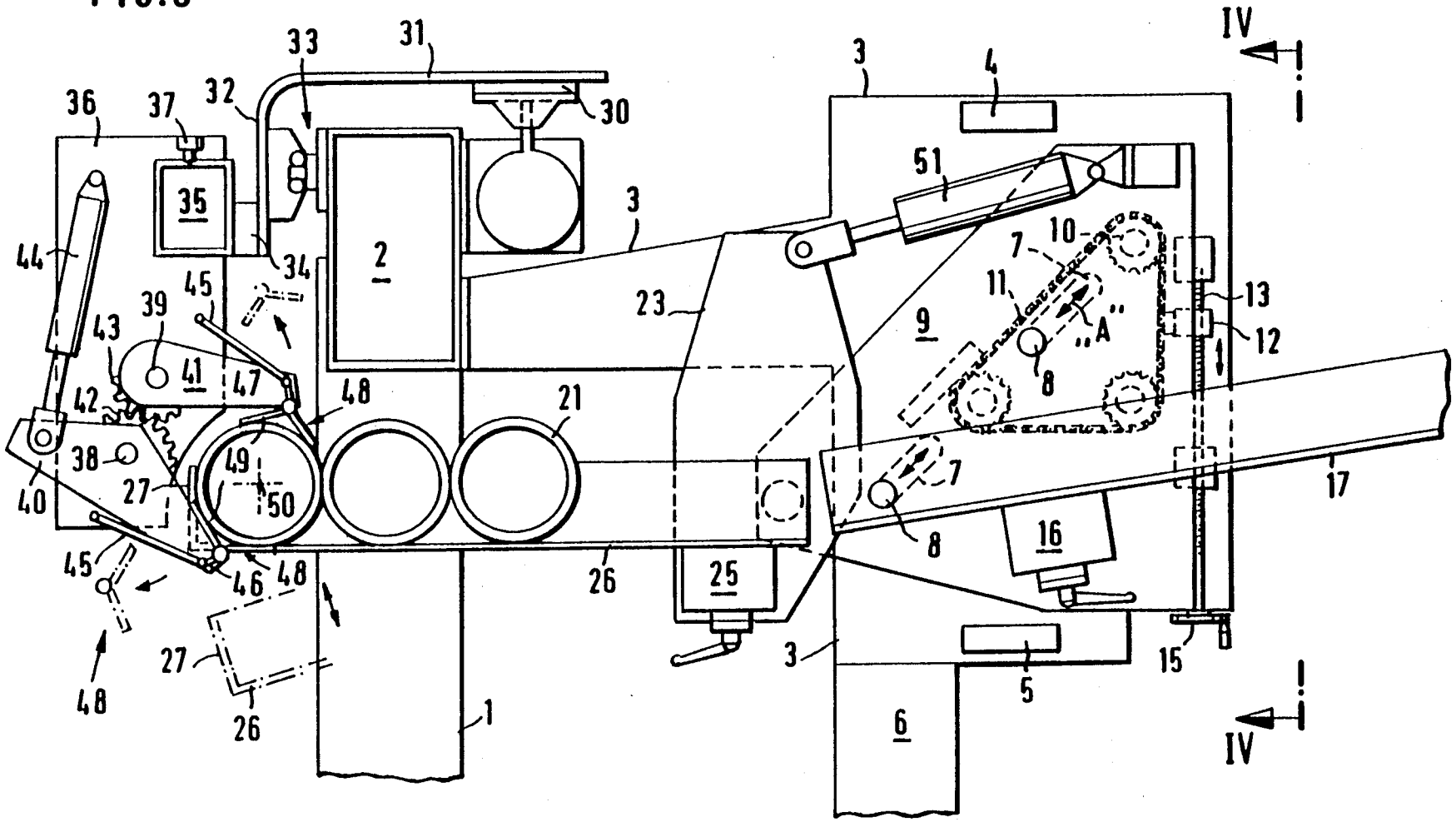
FIG. 3 is a view on a larger scale of the left part of the device of FIG. 1.
Figure 4:
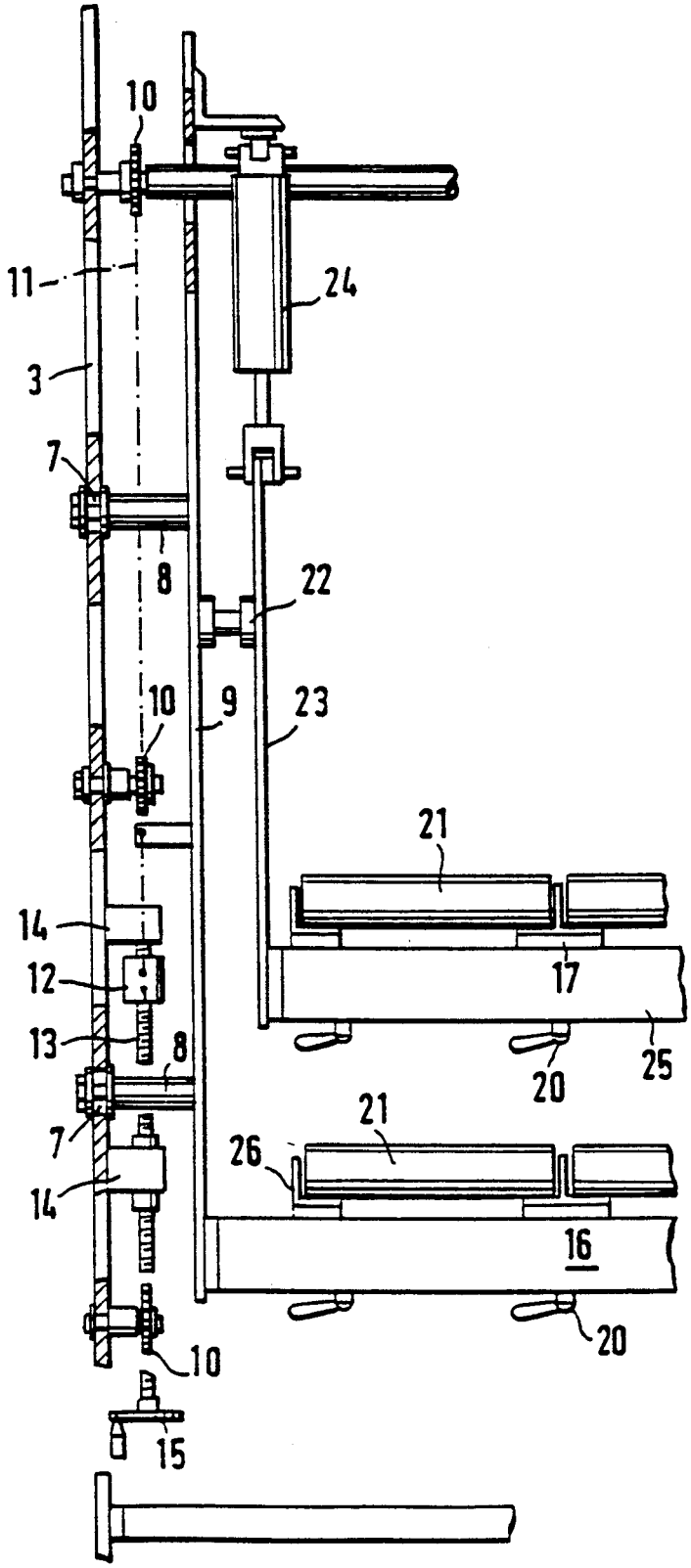
FIG. 4 is a view of the device in the form of a section taken on the line IV—IV of FIG. 3.

As may be seen from FIG. 3, the guide rails 26 bear 5 abutments 27 at their front end and such abutments prevent the individual cores from rolling off the guide rails 26 forwards, that is to say to the left in terms of FIG. 3. It is not possible for the cores 21 to roll down to the right, since the guide rails 26 adjoin the guide rails 17 and the latter run upwards to the right.

Figure 5:
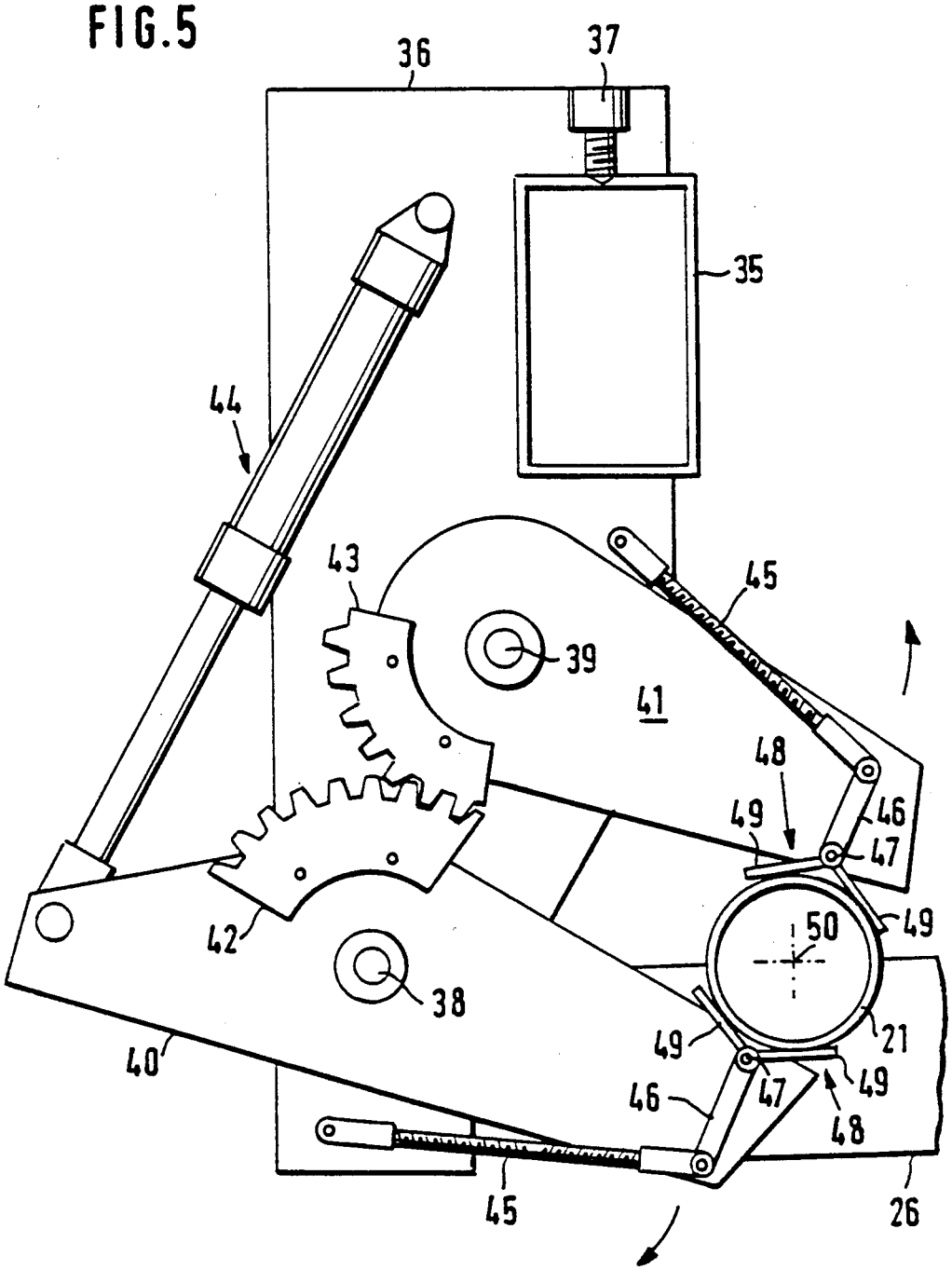
FIG. 5 shows the part, marked in a circle in FIG. 2, which forms the left part of FIG. 3, on a larger scale.
Figure 6:
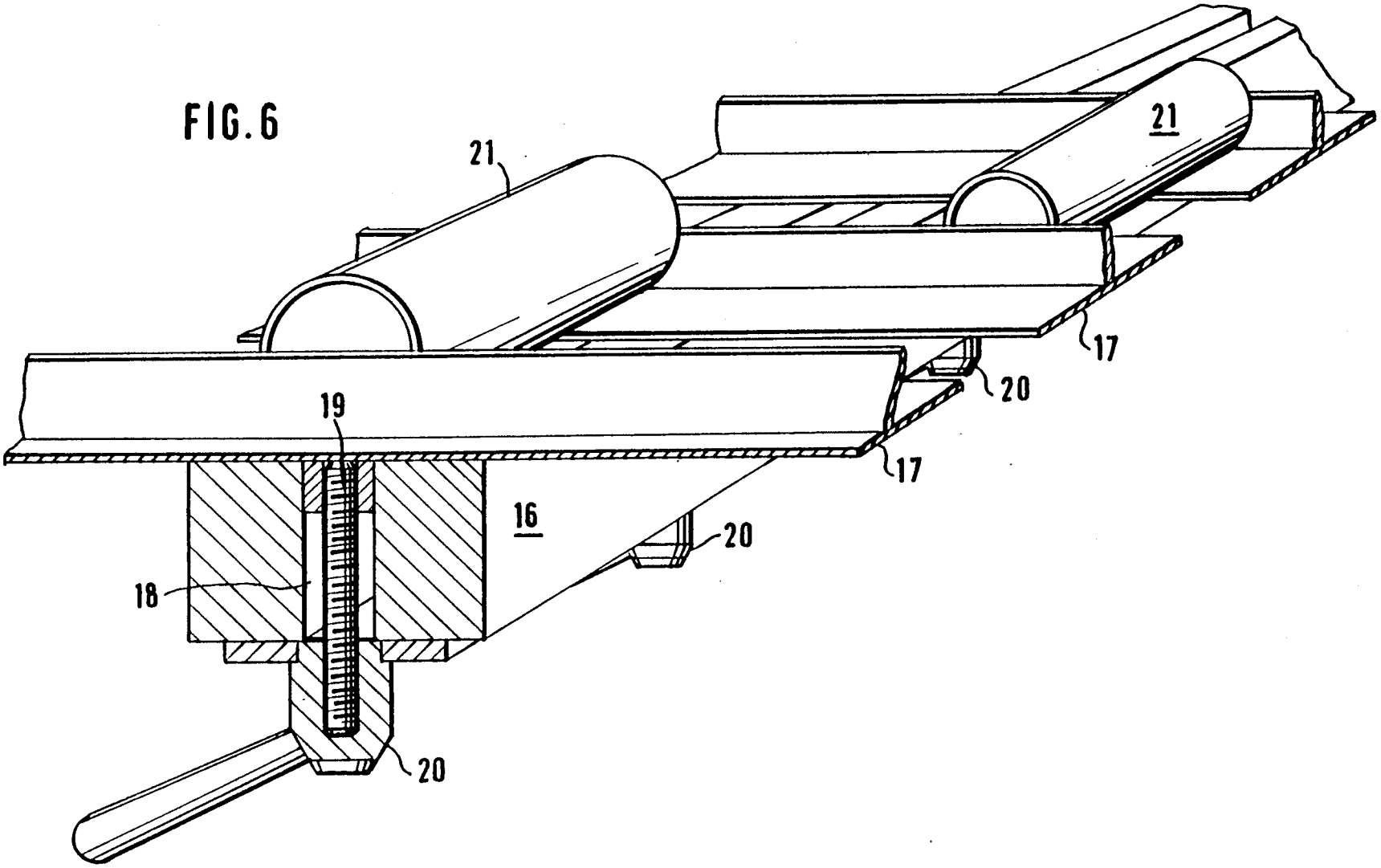
FIG. 6 is a perspective view of the guide tracks, embodied in the form of guide rails, for the winding cores.

As indicated in FIGS. 2 and 3, a pistonrodless cylinder actuator unit 28 (Orega actuator) is connected with the transverse girder 2 and the pin 29 connected with the piston thereof is joined with a carrier plate 30. This carrier plate 30 carries two lugs 31 which are angled at one end and, extending in a downward direction, are partly fitted around the transverse girder 2. The angled ends 32 of these lugs 31 bear against the transverse girder 2 by the intermediary of rolling element tracks 33. Intermediate members 34 are attached to the cantilever ends and such members 34 carry a guide rail 35. As will be seen from FIG. 2, five equally spaced carrier plates 36 are mounted on this guide rail 35 and are locked in place by means of screws 37. One of these carrier plates 36 is represented in FIG. 5 on a larger scale. It will be seen from this Figure that the carrier plate 36 has two trunnions 38 and 39, on each of which a pivoting arm 40 and 41, respectively, is mounted for free pivoting motion. Each of these pivoting arms has a toothed segment 42 and, respectively, 43, which are in meshing engagement with each other. It is in this manner that the two pivoting arms 40 and 41 may be pivoted towards and away from each other by the action of a piston and cylinder actuator 44 connected with the carrier plate 36. Each arm 40 and 41 has a part of a gripping device associated with it, which consists of a link or rod 45, whose one end is connected in a freely rotating manner with the plate 36 and whose other end articulates with a lever 46, whose end remote from the rod 45 is connected in a freely rotatable manner with the arm 40 and, respectively, 41 by way of the bolt 47. Adjacent to these bolts 47, grippers 48 are fixedly joined to the levers 46. These grippers 48 consist of two plates 49 placed at an angle to each other. In order to ensure that these plates 49 simultaneously come into engagement with the winding core 21, the pivot point of the rod 45 on the carrier plate 36 and the position of the bolt 47 on the arm 40 or 41 are so selected that the line bisecting the angle between the two plates of a gripper 48 extends through the center axis 50 of a core 21. In order to be able to make an initial adjustment, the rod 45 is provided with screw threads of opposite hand, such threads running in two female threaded sleeves mounted on the rod 45. As already noted, this adjustment represents a basic adjustment and once the device has undergone such initial setting it does not have to be reset.

Figure 1:
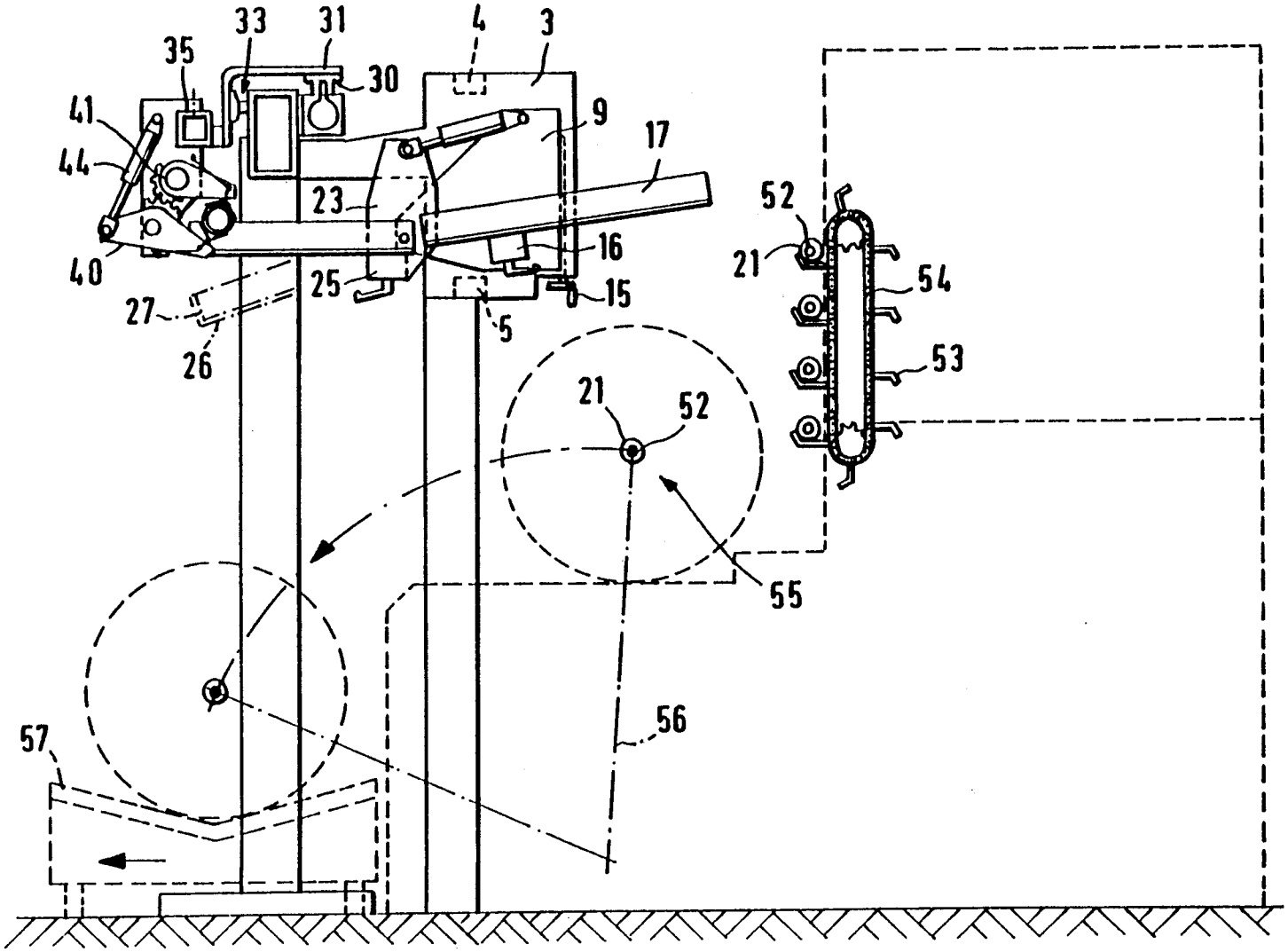
FIG. 1 shows a device for slipping winding cores on to a support in a diagrammatic side elevation.

For the operation of this device in accordance with the invention the first step is for all the guide rails 17 and 26 to be charged with winding cores 21 of the desired diameter. In accordance with the size of the diameter of the cores 21 the position of the plates 9 and 23 is reset by turning the handwheel 15 until the center axes of the cores, which are in engagement with the abutments 27, assume such a position that the two grippers of each unit simultaneously come into engagement with the cores 21. This setting may for example be indicated by means of a pointer on the plate 9 and graduations on the two plates 3 in accordance with the diameters of the winding cores which have been put in. Such adjustment having been completed, the opened grippers indicated in broken lines in FIG. 3 are moved towards each other by the piston and cylinder actuator 44 until the front core 21 has been engaged by the same. It will be clear from FIG. 2 that the device which is only shown once in FIG. 5 is in fact repeated five times, i.e. there are five devices as in FIG. 5 so that five cores may be engaged at one and the same time. After engagement of the winding cores the guide rails 26 are moved into the lowered position shown in FIG. 3 downwards by means of the piston and cylinder actuator 24. By operation of the Orega actuator 28 the guide rails together with all five carrier plates 36 mounted thereon are so moved in the direction of the arrow B (see FIG. 2) on the transverse girder 2 that all five cores 21 held in relation to each other by the gripping units are slipped onto a free winding shaft in the standby position. This winding shaft 52 is represented in broken lines in FIG. 2 and it may be moved for instance by a separate charging device into the desired position. After the winding cores 21 have been slipped onto the winding shaft 52 the latter is expanded so that the winding cores are fixed in their relative positions to each other, even after the gripper units 48 have been opened again and the guide rail 35 has been moved back in its basic setting as shown in FIG. 2. As diagrammatically indicated in FIG. 1, it is then possible for the individual winding shafts 52 charged with the cores 21 to be placed in the carrier 53 of a vertical conveyor 54 and to be moved from this position when required to a winding device 55, which is only sketched roughly in the drawing. After the winding operation it is then possible for the winding shaft 52 to be deposited in a conventional manner by a pivoting arm 56 on a conveying carriage 57 and conveyed away. As stated, this arrangement is only one possible example of the invention; the winding shafts having the winding cores thereon may naturally be deposited at some other station, as for instance in storage premises.

I claim:

1. A device for placing a plurality of winding cores on an expandable winding shaft with a given relative positioning of the winding shaft, said device comprising:

a stand, a frame mounted on said stand, said frame having sets of mutually parallel guide tracks for a coaxial, adjacent plurality of winding cores fed thereto in a transverse position and spaced from each other by said mutually parallel guide tracks, a distance between the guide tracks being equal to a width of the winding cores and a distance between the winding cores located on the tracks corresponds to a desired spacing of winding cores on the winding shaft, abutments and recesses located in front parts of said tracks for engaging foremost winding cores, tong-like grippers located in the stand for each respective winding core, said grippers having gripping jaws arranged to substantially simultaneously engage opposite sides of the winding cores, and the grippers and the frame being moved relative to each other so that the winding shaft may be inserted through aligned bores of the plurality of winding cores when the winding cores are separated from the tracks and held by the grippers.

2. The device as claimed in claim 1, wherein the frame is slidingly mounted in the stand at an angle which is approximately equal to 45 degrees to sections of the track supporting the front winding cores.

3. The device as claimed in claim 1, wherein the guide tracks are formed by end parts of guide rails supporting the winding cores, the guide rails being slidingly supported on transversely extending guides of the frame and having means for locking the guide rails in place.

4. The device as claimed in claim 3, wherein the guide rails are in the form of an angle section.

5. The device as claimed in claim 1, wherein the frame comprises a front part with generally horizontally extending guide rails and a rear part with obliquely extending guide rails.

6. The device as claimed in claim 1, wherein the front part of the frame is pivotally mounted in its rear part for rocking about a transverse axis and is able to be lifted and lowered in relation to the frame by a drive means.

7. The device as claimed in claim 1, wherein the rear part of the frame is arranged to be guided by oblique guide means secured to said stand and is provided with a setting drive.

8. The device as claimed in claim 7, wherein the setting drive comprises a lead screw and an endless chain driven running over sprocket wheels and coupled with the frame.

9. The device as claimed in claim 1, wherein each of the gripping jaws comprises gripping plates arranged at an angle to each other.

10. The device as claimed in claim 1, wherein the gripping jaws are secured to pivoting arms adapted to rock synchronously in opposite directions.

11. The device as claimed in claim 10, wherein the pivoting arms are coupled together by toothed segments which are concentric to the pivot axes thereof and are in mesh with each other.

12. The device as claimed in claim wherein the gripping jaws are mounted on levers which are pivotally mounted on pivoting arms so that their ends opposite to the gripping jaws are pivoted on first ends of links, whose other, second ends are pivoted on girders which are at least indirectly fixed to the stand, the lengths of the levers and links are so selected that the levers bearing the gripping surfaces are aligned with each other substantially during the opening and closing motion.

13. The device as claimed in claim 1, wherein the grippers are attached to a common carrier, which is able to be moved by drive means on a girder which is secured to the stand and which extends in parallel to the winding cores engaged by the grippers.

* * * * *